US005237746A

United States Patent [19]

Aoki et al.

[11] Patent Number: 5,237,746

[45] Date of Patent: Aug. 24, 1993

[54] METHOD OF PREPARING CYLINDRICAL ALUMINUM SUBSTRATE FOR ELECTROPHOTOGRAPHIC PHOTORECEPTOR

[75] Inventors: Motohisa Aoki, Tokyo; Yasuo Soyama, Joetsu; Katsuji Sakata, Hiratsuka, all of Japan

[73] Assignee: Mitsubishi Kasei Corporation, Tokyo, Japan

[21] Appl. No.: 3,869

[22] Filed: Jan. 11, 1993

Related U.S. Application Data

[63] Continuation of Ser. No. 853,856, Mar. 19, 1992, abandoned, which is a continuation of Ser. No. 631,941, Dec. 21, 1990, abandoned.

[30] Foreign Application Priority Data

Dec. 22, 1989 [JP] Japan ..... 1-331385

[51] Int. Cl.[5] ..... B21C 27/00

[52] U.S. Cl. ..... 29/895.32; 29/527.4; 72/272

[58] Field of Search ..... 72/269, 272, 467; 29/895.32, 527.4

[56] References Cited

U.S. PATENT DOCUMENTS

| | | | |
|---|---|---|---|
| 4,095,449 | 6/1978 | Roach et al. | 72/467 |
| 4,468,947 | 9/1984 | Takeda et al. | 72/467 |
| 4,598,567 | 7/1986 | Backus | 72/269 |
| 4,769,346 | 9/1988 | Gadkaree et al. | 72/467 |
| 5,095,730 | 3/1992 | Lauder | 72/467 |

FOREIGN PATENT DOCUMENTS

| | | | |
|---|---|---|---|
| 2900909 | 7/1979 | Fed. Rep. of Germany | 72/467 |
| 178122 | 10/1984 | Japan | 72/467 |
| 149012 | 6/1988 | Japan | 72/467 |

OTHER PUBLICATIONS

Ser. No. 362,833, Alien Property Custodian, May 1943, Hanff.

*Primary Examiner*—Lowell A. Larson

*Attorney, Agent, or Firm*—Oblon, Spivak, McClelland, Maier & Neustadt

[57] ABSTRACT

A method for preparing a drum comprising a cylindrical aluminum substrate coated with an electrophotographic photoreceptor having reduced streak defects which comprises forming the cylindrical aluminum substrate by the porthole method using a mold having ceramic surfaces.

8 Claims, No Drawings

METHOD OF PREPARING CYLINDRICAL ALUMINUM SUBSTRATE FOR ELECTROPHOTOGRAPHIC PHOTORECEPTOR

This application is a continuation of application Ser. No. 07/853,856, filed on Mar. 19, 1992, which is a continuation of Ser. No. 07/631,941, filed on Dec. 21, 1990, both now abandoned.

BACKGROUND OF THE INVENTION

1. Field of the Invention

The present invention relates to a method of preparing a cylindrical aluminum substrate for electrophotographic photoreceptors. The cylindrical substrates, "drums", are used in photocopiers, laser printers and similar devices.

2. Discussion of the Background

Several methods of preparing a cylindrical aluminum substrate ("aluminum" includes not only aluminum metal of a single substance but also aluminum alloys) which is used as a substrate of an electrophotographic photoreceptor, are known including: (1) preparing a bottomed cylinder in which aluminum is formed into a cup-shaped article by deep-drawing and then the wall of the cup is expanded by ironing to form a bottomed aluminum cylinder (Drawing and Ironing method); (2) preparing a cylinder in which aluminum is formed into a cup-shaped article by impact extrusion and then the wall of the cup is expanded by ironing to form an aluminum cylinder (Impact and Ironing method); (3) preparing a thin-walled cylinder in which an aluminum cylinder, obtained by extrusion, is expanded by ironing to form a thin-walled aluminum cylinder (Extrusion and Ironing (EI) method); and (4) preparing a thin-walled cylinder in which an aluminum cylinder, obtained by extrusion, is subjected to deep-drawing to form a thin-walled aluminum cylinder (Extrusion and Drawing (ED) method); as well as methods of cutting and machining the cylindrical article prepared by one of these methods. In the EI method and ED method as well as those followed by a cutting step, extrusion is effected as the inter-working step.

Two means of preparing a hollow pipe by extrusion working are known, one is a mandrel system process and the other is a porthole system process. In the mandrel system process a mandrel is fixed at the top of the stem of the extruder and is used as a core and a hollow pipe is prepared by extrusion. However, the process has several drawbacks in that the wall of the hollow pipe is often uneven and formation of a thin-walled pipe is difficult. Therefore, the porthole system process is employed most often in producing a cylindrical aluminum substrate for electrophotographic photoreceptors. In the porthole system, the metal is extruded into a multi-part die, usually having two parts, and the parts are welded in the mold to form a hollow pipe therein. The system is superior to the mandrel system process since it forms even walls and is capable of forming thin-walled hollow pipe. However, the system has one drawback, the hollow pipe formed has a weld line caused by the welding.

The weld line would not cause any particular problem when the hollow pipe formed is used in general structures, since a favorable metal-constitutional conjugation may be attained in the welded part of the pipe provided that the extrusion condition is suitably adjusted. However, when a cylindrical aluminum substrate is formed by extrusion in the port-hole system process and is coated with a photo-conductive layer to form an electrophotographic photoreceptor, streak defects appear in the position corresponding to the weld line in the substrate. In severe cases the defects may be detected with the naked eye on the photo-conductive layer as formed on the electrophoto-graphic photoreceptor. However, even when such defects can not be detected with the naked eye, they cause image defects running along the direction of the axis of the cylindrical substrate on the duplicated images formed by the electro-photographic photoreceptor, i.e. the image contains streaks.

Thus, an object of the present invention is to provide a method of preparing a cylindrical aluminum substrate for an electrophotographic photoreceptor, which is free from the defects in the position corresponding to the weld line formed during extrusion of the cylindrical aluminum substrate and is also free from streak defects in the duplicated images formed by the cylindrical aluminum substrate electrophotographic photoreceptor, the drum, prepared from the cylindrical aluminum substrate.

Another object of the present invention is to provide a method of preparing an electrophotographic photoreceptor drum which has very few defects and its use results in images having very few defects. Still another object of the present invention is to provide an excellent and defect-free electrophotographic drum.

The present inventors have found that the above-mentioned defects are derived from the oxides which are on the surface of the mold and are incorporated onto the weld line from the surface of the mold during extrusion. Specifically, since the oxides incorporated onto the weld line from the surface of the mold are extremely hard and brittle, as compared with the aluminum matrix, they are often broken by the drawing, ironing or cutting work applied to the surface of the substrate after the extrusion and form pores, or the oxides remain unprocessed and form projections. If a photo-sensitive layer is coated on the substrate having such pores or projections on the weld line thereof, thin and uneven portions of the photo-sensitive film are formed around the pores or projections. It has been found that such thin and uneven portions cause streak defects on the electrophotographic photoreceptor and also cause streak-like patterns on the images formed by the defective electrophotographic photoreceptor.

Accordingly, to overcome such defects, it is recommended to employ a means which avoids oxidizing the surface of the extrusion mold used for extrusion of the cylindrical aluminum substrate.

In general, an extrusion mold is made of an alloy tool steel of JIS (Japanese Industrial Standard) type. In the extrusion of aluminum, in general, the cavity of the extrusion mold after completion of one extrusion step contains an aluminum residue. Therefore, it is a general practice to remove the aluminum residue from the cavity of the extrusion mold by the use of an alkali substance such as sodium hydroxide or the like, in the interval after completion of the extrusion step and before the next extrusion step. Because of the alkali treatment, the surface of the extrusion mold made of an alloy tool steel, after the aluminum residue has been removed, is coated with an oxide film.

Further, in the next step, the extrusion mold is heat-treated, generally at a temperature of from 450° to 550° C. for several hours. The heat-treatment step, further oxidizes the surface of the extrusion mold made of an alloy tool steel resulting in an oxide film coating.

SUMMARY OF THE INVENTION

The present inventions have discovered that an extrusion mold of which at least the surface is made of ceramics is extremely effectively used for the intended extrusion method and overcomes the difficulties described above. On the basis of such finding, they have achieved the present invention.

Specifically, in accordance with the present invention, there is provided a method of preparing a cylindrical aluminum substrate for an electrophotographic photoreceptor by extrusion working by the porthole system, comprising using an extrusion mold of which at least the surface is made of ceramics in the extrusion working step of the porthole system.

Bisazo Compound:

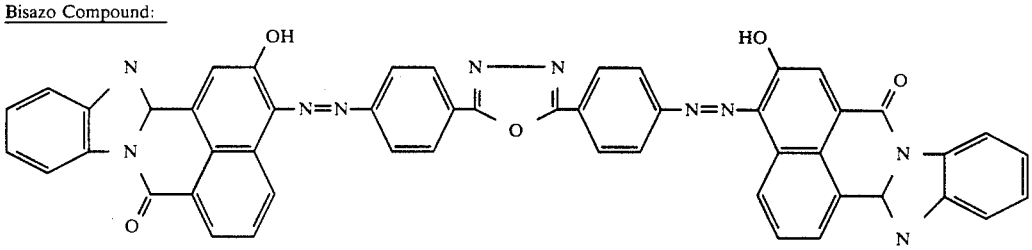

DETAILED DESCRIPTION OF THE INVENTION

The mold used in the extrusion step of the present invention is one in which at least the surface is made of ceramics. For example, a metal mold of which the surface is coated with ceramics such as TiN, TiC, $Al_2O_3$, SiN or ZrC, a mold entirely made of ceramics such as $Si_3N_4$, sialon, zirconia or alumina, and a mold a part of which is made of ceramics and the other part of which is made of metal coated with ceramics can be used. Any of the conventional techniques for forming ceramic coatings may be used to coat the mold. Ceramic molds may be made using conventional technology well-known in the art.

The substrate itself may be made of an aluminum metal of a simple substance or made of an aluminum alloy which is of a type generally employed in this field.

Next, the present invention will be explained in more detail by way of the following examples, which, however, are not intended to restrict the scope of the present invention.

EXAMPLE 1

An aluminum alloy of JIS 6063 was melted, degassed and filtrated, was cast into billets each having a size of 178 mm (diameter)×6,000 mm (length) by semi-continuous casting. These were cut into pieces each having the desired length and used in the next extrusion step which follows.

A TiN film having a mean thickness of 2.5 microns was coated on the surface of an extrusion mold made of JIS SKD 61 used in the porthole system extrusion process for forming hollow pipes having an outer diameter of 88 mm and an inner diameter of 80 mm, by the PVD process (ion plating process).

Next, the extrusion mold was heated in an aerial furnace at 550° C. for 8 hours, and the above-mentioned billets were extruded therethrough under an oil pressure of 1700 T capacity to give a hollow pipe having an outer diameter of 88 mm and an inner diameter of 80 mm.

The, thus, formed hollow pipe was cut and cold-drawn to yield a hollow pipe having an outer diameter of 80.5 mm and an inner diameter of 76 mm. The pipe was then cut and was faced by turning to give a mirror-face tube having an outer diameter of 80 mm, an inner diameter of 76 mm and a length of 340 mm.

100 parts of 4-methoxy-4-methylpentanone-2 was added to 10 parts of bisazo compound having the following structural formula, 5 parts of phenoxy resin (PKHH, product by Union Carbide Co.) and 5 parts of polyvinyl butyral resin (BH-3, product by Sekisui Chemical Co.) and ground and dispersed with a sand-grinding mill. The previously obtained mirror-face tube was dipped in the resulting dispersion, whereby a charge-generating layer having a dry thickness of 0.4 microns was formed on the surface of the tube.

The thus obtained aluminum pipe having a charge-generating layer was then dipped in a solution comprising 90 parts of N-ethylcarbazole-3-aldehyde-diphenylhydrazone, 100 parts of polycarbonate resin and 4.5 parts of cyano compound having the following structural formula as dissolved in 900 parts of 1,4-dioxane, whereby a charge-transporting layer having a dry thickness of 20 microns was formed over the charge-generating layer.

Cyano Compound:

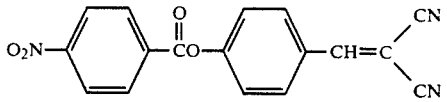

EXAMPLE 2

A hollow pipe having an outer diameter of 88 mm and an inner diameter of 80 mm was prepared by extrusion in the same manner as in Example 1, then the extrusion mold was released from the oil press, it was then dipped in an aqueous 20% NaOH solution and heated at 80° C. for 15 hours whereby the aluminum residue remaining in the mold was dissolved and removed. The, thus, treated extrusion mold was heated in an aerial furnace at 550° C. for 8 hours. Then, the same process as in Example 1 was repeated, to obtain an electrophotographic photoreceptor.

EXAMPLE 3

An electrophotographic photoreceptor was prepared in the same manner as in Example 1, except that a TiC film having a mean thickness of 2.5 microns was formed on the surface of the mold by PVD process.

EXAMPLE 4

A hollow pipe having an outer diameter of 88 mm and an inner diameter of 80 mm was prepared by extrusion in the same manner as in Example 3, then the extrusion mold was released from the oil press and dipped in an aqueous 20% NaOH solution and heated at 80° C. for 15 hours whereby the aluminum residue remaining in the mold was dissolved and removed. The, thus, treated extrusion mold was heated in an aerial furnace at 550° C. for 8 hours. Then the same process as in Example 1 was repeated, to obtain an electrophotographic photoreceptor.

COMPARATIVE EXAMPLE 1

A comparative electrophotographic photoreceptor was prepared in the same manner as in Example 1, except that the TiN film was not coated on the surface of the extrusion mold.

COMPARATIVE EXAMPLE 2

A comparative electrophotographic photoreceptor was prepared in the same manner as in Example 2, except that the TiN film was not coated on the surface of the extrusion mold.

One hundred samples of each of the electrophotographic photoreceptors as prepared in Examples 1 to 4 and Comparative Examples 1 and 2 were set in a commercial copy machine and the machine was operated to form half-tone images, whereupon the percentage of the image defects (streaks), if any, was checked in each image. The results obtained are shown in Table 1 below.

TABLE 1

| | Percentage of Streak Defects |
|---|---|
| Example 1 | 0% |
| Example 2 | 0% |
| Example 3 | 0% |
| Example 4 | 0% |
| Comparative Example 1 | 52% |
| Comparative Example 2 | 80% |

As is apparent from the above results, the electrophotographic photoreceptor having the cylindrical aluminum substrate prepared by the method of the present invention does not have either streak defects at the position corresponding to the weld line of the substrate no streak patterns in the duplicated image. In contrast, the electrophotographic photoreceptor having the conventional cylindrical aluminum substrate caused the unfavorable streak patterns in the duplicated image. From the results, the effect of the present invention is obvious.

While the invention has been described in detail and with reference to specific embodiments thereof, it will be apparent to one skilled in the art that various changes and modifications can be made therein without departing from the spirit and scope thereof.

What is claimed as new and desired to be secured by Letters Patent of the United States is:

1. A method for preparing an electrophotographic photoreceptor having reduced streak defects which comprises:

(i) forming a cylindrical aluminum substrate by the porthole extrusion method using an extrusion mold, including the mold cavity, having ceramic surface; and (ii) applying drawing, ironing or cutting work to the surface of said cylindrical aluminum substrate after said extrusion thereby forming a thin-walled cylindrical aluminum substrate;

(iii) coating a photo-sensitive layer on said thin-walled cylindrical aluminum substrate.

2. The method of claim 1, wherein said extrusion mold is a metal mold coated with a ceramic material of TiN, TiC, $Al_2O_3$, SiN or CrC.

3. The method of claim 1, wherein said extrusion mold is a ceramic mold comprised of $Si_3N_4$, sialon, zirconia or alumina.

4. A method for preparing an electrophotographic photoreceptor comprising:

(i) forming a cylindrical aluminum substrate by the porthole extrusion method using an extrusion mold wherein the entire mold surface, including the mold cavity surface, consists essentially of a ceramic material;

(ii) then applying a drawing, ironing, or cutting work to the surface of said cylindrical aluminum substrate, thereby forming a thin-walled cylindrical aluminum substrate;

(iii) coating a photosensitive layer on said thin-walled cylindrical aluminum substrate.

5. The method of claim 4, wherein said ceramic material is TiN, TiC, $Al_2O_3$, SiN, or CrC.

6. The method of claim 4, wherein said extrusion mold consists essentially of $Si_3N_4$, sialon, zirconia or alumina.

7. The method of claim 4, wherein said photo-sensitive layer comprises a charge-generating layer and a charge-transporting layer.

8. The method of claim 7, wherein said charge generating layer comprises a bisazo compound and said charge-transporting layer contains a cyano compound.

* * * * *